US007487613B2

(12) United States Patent
Taylor

(10) Patent No.: US 7,487,613 B2
(45) Date of Patent: Feb. 10, 2009

(54) CARTRIDGE LOADER FOR INSERTING CARTRIDGES INTO A GUN MAGAZINE

(76) Inventor: Stephen J. Taylor, 64422 Del Rey Rd., Joshua Tree, CA (US) 92252

( * ) Notice: Subject to any disclaimer, the term of this patent is extended or adjusted under 35 U.S.C. 154(b) by 21 days.

(21) Appl. No.: 11/697,199

(22) Filed: Apr. 5, 2007

(65) Prior Publication Data

US 2008/0244952 A1 Oct. 9, 2008

(51) Int. Cl.
*F41A 9/83* (2006.01)

(52) U.S. Cl. ..... 42/87; 42/90

(58) Field of Classification Search ..... 42/87, 42/88, 90

See application file for complete search history.

(56) References Cited

U.S. PATENT DOCUMENTS

| | | | | |
|---|---|---|---|---|
| 4,679,343 | A | 7/1987 | Harlow | |
| 4,993,180 | A | 2/1991 | Upchurch | |
| 5,249,386 | A | 10/1993 | Switzer | |
| 5,355,606 | A | 10/1994 | Origoni | |
| 5,377,436 | A | 1/1995 | Switzer | |
| 5,402,594 | A | 4/1995 | Switzer | |
| 5,417,003 | A | 5/1995 | Claveau | |
| 6,178,683 | B1 | 1/2001 | Williams | |
| 6,189,254 | B1 * | 2/2001 | Steitz | 42/87 |
| 6,219,953 | B1 * | 4/2001 | Bentley | 42/90 |
| 6,817,134 | B2 | 11/2004 | Newman | |
| 2004/0159035 | A1 | 8/2004 | Newman | |

FOREIGN PATENT DOCUMENTS

| | | |
|---|---|---|
| GB | 555367 | 8/1943 |

* cited by examiner

*Primary Examiner*—J. W Eldred
(74) *Attorney, Agent, or Firm*—Christopher Wood; Wood & Eisenberg, PLLC

(57) ABSTRACT

A cartridge loader for inserting cartridges into a gun magazine. The cartridge loader fits onto a person's thumb and more particularly fits onto the distal phalange of a person's thumb. In one embodiment of the invention, the cartridge loader includes a thumb protecting member and a cartridge-pushing member. The thumb-protecting member defines interior and exterior surfaces and an interior open cavity of sufficient volume and shape to accommodate a distal phalange of a person's thumb. The cartridge-pushing member defines opposite first and second ends. The first end of the cartridge-pushing member is attached to the exterior surface of the thumb-protecting member. The second end of the cartridge-pushing member defines, at least in part, a concave surface to suit the exterior shape of a cartridge casing.

5 Claims, 15 Drawing Sheets

(Prior-Art)

CARTRIDGE LOADER FOR INSERTING CARTRIDGES INTO A GUN MAGAZINE

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates to a cartridge loader for loading cartridges into a detachable magazine for use in a firearm.

BACKGROUND OF THE INVENTION

As noted in the online encyclopedia Wikipedia™, the word "bullet" is often used incorrectly to refer to the combination of bullet, case, gunpowder and primer; such an item is properly called a cartridge, or round. The term "cartridge" is properly used herein to refer to the combination of bullet, case, gunpowder and primer.

Given the frequent misuse of the term "bullet", a schematic of a cartridge is shown in prior art FIG. 15. As shown, a cartridge C typically comprises a bullet 1, a casing 2, propellant such as gunpowder 3, rim 4, and primer 5. The cartridge casing 2 defines a proximal end 10 and a distal end 15. The cartridge casing 2 has proximal and distal ends 10 and 15, respectively. The rim 4 is located at the casing's proximal end 10 proximate to an extractor groove 20. The bullet 1 is attached to the distal end 15 of cartridge casing 2. The cartridge casing 2 is typically of cylindrical appearance with the distal end 15 possibly tapering to accommodate a bullet of smaller diameter than the cartridge casing.

As noted in U.S. Patent Publication No. 20040159035, most semi-automatic and automatic weapons are provided with a removable magazine for holding a large number of cartridges. Additionally, some handguns, such as 9 mm pistols, are structured to receive a cartridge-holding magazine, often referred to as a "clip" (also referred to as a "cartridge clip"). Regardless of the particular type, make or model of the weapon, virtually all magazines are structured to function according to the same general principal of operation. Specifically, the magazine includes a generally elongate, vertical chamber with partially open ejection end at the top. Cartridges are loaded, in sequence, into the magazine and against the compression force exerted by a compression spring, so that a stacked arrangement of cartridges within the magazine is urged upwardly towards the top ejection end. When the loaded magazine is inserted into the firearm, the force of the compression spring causes the cartridges to be individually fed, one at a time in succession, into the gun's firing chamber.

As noted in U.S. Pat. No. 5,402,594, a substantial compression spring force must be available in a cartridge clip in order to properly move a succeeding cartridge in sequence to the magazine's ejection end after a preceding cartridge has been ejected from the magazine. When the magazine is reloaded, i.e., after all cartridges have been ejected from the magazine, the compression spring must be compressed in response to the sequential loading of each individual cartridge until the clip's maximum cartridge supply is received. The more cartridges that are put into the clip, the greater the resistance of the compression spring against further compression. The force required to load the last cartridge into the magazine is significantly greater than the force required to load the first cartridge into the magazine.

There is a continuing need for devices that facilitate gun owners in loading cartridges into gun magazines.

A review of the prior art follows.

U.S. Pat. No. 5,402,594 patent issued to Switzer describes a cartridge loader for a cartridge clip. The '594 loader includes a loader sleeve slidingly receivable on the magazine to compress the clip's spring in order to permit easy reloading of the clip. A brake connected to the sleeve co-acts with the magazine's sidewall surface so as to impede the sleeve from disengagement with the magazine in the event the sleeve is inadvertently released by a user when the clip's spring is compressed and with no cartridges present in the clip. In preferred form, the brake is comprised of a brake arm that causes the sleeve to slide in a frictional braking relation with the clip's sidewall surface and that itself slides in a frictional braking relation with the clip's sidewall surface. Patent Publication No. 20040159035 describes a rapid action cartridge reloading device for use in conjunction with a firearm utilizing a removable magazine. The '035 device is described as being operable by either hand of the user with minimal effort. The '035 device includes a sleeve, defining a main body, a lever hinged to the sleeve and a cam member operatively engaged with the lever. The sleeve is structured and disposed to receive the magazine in a releasably locked and registered position for the cartridge reloading operation. The device is operated by squeezing the lever towards the sleeve body with one hand that rotates the cam member about a cam axis in a highly leveraged action. Rotation of the cam causes an integral finger extending from the cam member to engage and depress a properly positioned cartridge into the magazine. A spring urges the cam member back to the relaxed position upon each release of the lever, whereupon a next successive cartridge can be placed in registered position for loading. In several embodiments, a hood is hingedly fitted to the top end of the sleeve body and includes an axial bore, defining a loading chamber, through which the cartridges are inserted, using the other hand to guide each cartridge into the registered loading position.

In addition, the U.S. Pat. No. 5,377,436 patent, also to Switzer, describes a reloader for a cartridge clip that allows the reloader and clip, when assembled for reloading purposes, to be held and operated in one of a user's hands while cartridges are reloaded in the clip with the other of the user's hands. The reloader includes a sleeve adapted to receive the clip in seated relation during reloading, and a handle connected to the sleeve against which the clip lies when the clip is in operational relation with the reloader, thereby allowing the clip and reloader to be held in operational assembly with one of the user's hands. The reloader also includes a plunger that is manually reciprocable to depress a top cartridge already seated in the cartridge clip to accommodate receiving another cartridge as a successor top cartridge in the cartridge clip. An operator arm connected with the plunger is manually operable by the user's thumb on that same one of the user's hands that holds the cartridge and clip in operational assembly, thereby leaving the other of the user's hands free to reload cartridges in the cartridge clip.

The U.S. Pat. No. 6,178,683 patent issued to Newman describes a reloader for a magazine having a generally L-shaped grip with a plurality of pairs of bores in the opposite end walls. The pairs of bores are selectively spaced so as to removably receive the pins on a plunger assembly. The magazine to be reloaded is held against the interior of the grip and the plunger may be manually depressed to depress the follower in the magazine allowing the user to insert cartridges with his or her free hand.

SUMMARY OF THE INVENTION

A cartridge loader for inserting cartridges into a gun magazine. The cartridge loader fits onto a person's thumb and more particularly fits onto the distal phalange of a person's thumb. In one embodiment of the invention, the cartridge loader includes a thumb protecting member and a cartridge-pushing member. The thumb-protecting member defines interior and exterior surfaces and an interior open cavity of sufficient volume and shape to accommodate a distal phalange of a person's thumb. The cartridge-pushing member defines opposite first and second ends. The first end of the cartridge-pushing member is attached to the exterior surface of the thumb-protecting member. The second end of the cartridge-pushing member defines, at least in part, a concave surface to suit the exterior shape of a cartridge casing.

BRIEF DESCRIPTION OF THE DRAWINGS

Similar reference characters denote corresponding features consistently throughout the attached drawings.

DETAILED DESCRIPTION OF THE INVENTION

Figure 1:
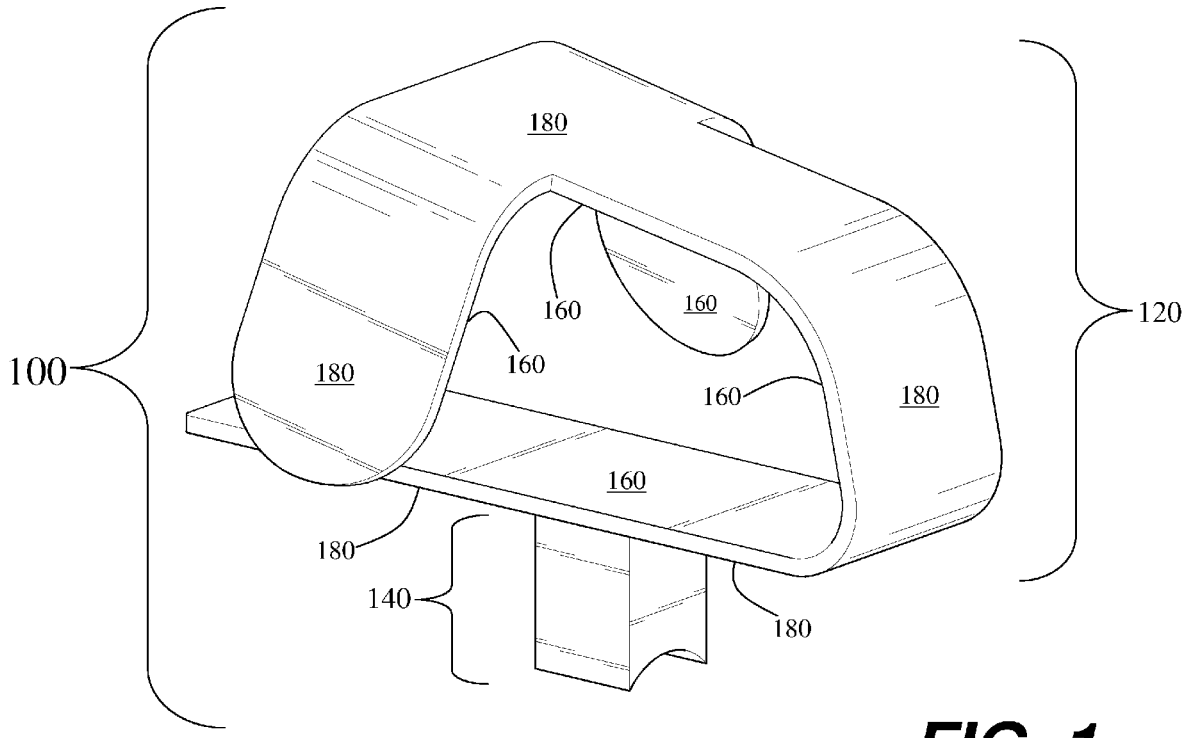
FIGS. 1 and 2 show various views of a cartridge loader according to the present invention.

The present invention is directed to a cartridge loader for loading cartridges C into a detachable magazine for use in a firearm.

Referring to the invention in general, the cartridge loader of the present invention comprises a thumb-protecting member 120 and a cartridge-pushing member 140. The thumb-protecting member 120 defines an interior surface 160, an exterior surface 180, and an interior open cavity 200 of sufficient volume and shape to accommodate the distal phalange DP of a person's thumb. The term "open" in the term "interior open cavity 200" means the cavity 200 is accessible to the distal phalange DP of a person's thumb. Optionally, at least part of or all of the interior surface 160 can be covered with an optional lining 210. The optional lining 210 provides a snug fit for the distal phalange DP of a person's thumb thereby reducing the risk of the person's distal phalange DP slipping and thereby possibly interfering with or slowing down the loading of cartridges C into a magazine. The lining also prevents direct contact between the interior surface 160 and the distal phalange DP of a person's thumb thereby reducing the risk of the person developing light tissue damage such as, but not limited to, friction blisters.

Still referring to the invention in general, the cartridge-pushing member 140 defines a length L and includes opposite first and second ends 220 and 240, respectively. The first end 220 of cartridge pushing-member 140 is attached to the exterior surface 180 of the thumb-protecting member 120. The second end 240 of the cartridge-pushing member 140 defines, at least in part, a concave surface 260 which provides optimal contact with the exterior cylindrical shape ECS of a cartridge casing 2.

Figure 2:
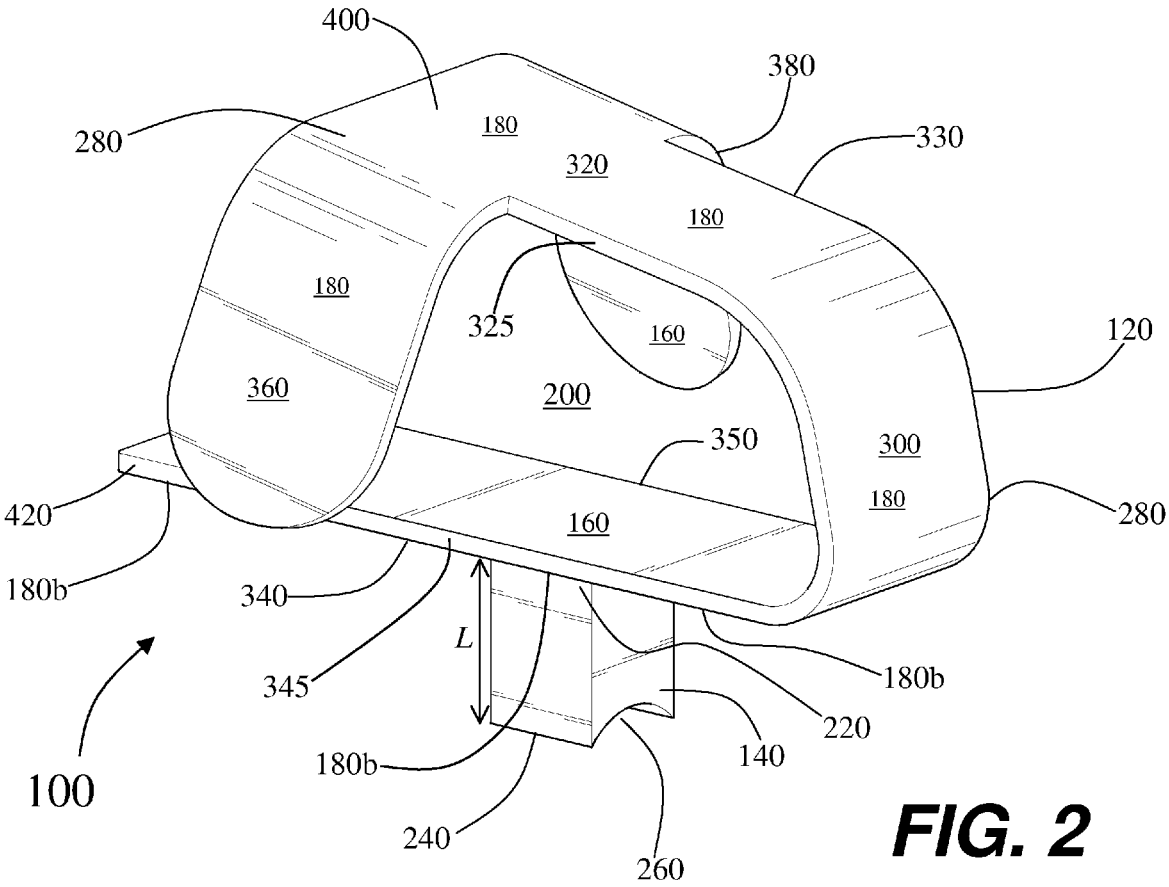

In more detail, FIGS. 1 and 2 show one embodiment of the invention in which the cartridge loader 100 comprises a thumb-protecting member 120 and a cartridge-pushing member 140. In this embodiment the thumb-protecting member 120 takes the form of a generally U-shaped member 280 having a front-end 300, a topside 320 and a bottom side 340. The topside 320 and bottom side 340 respectively define rear ends 400 and 420. Bottom side 340 defines exterior service **180*b*, wherein exterior surface 180*b* forms part of exterior surface 180. The topside 320 defines first and second opposite sides 325 and 330, respectively. The topside 320 defines first and second opposite sides 325 and 330**, respectively.

The bottom side 340 defines first and second opposite bottom sides 345 and 350, respectively. The top side 320 is optionally inclined at a positive angle from the front end 300 to the rear end 400 in order to mimic the thickness of the distal phalange of a person's thumb which typically increases from the tip end to the joint end of the distal phalange. The generally U-shaped member 280 and cartridge-pushing member 140 can be made out of any suitable material such as metal (e.g., aluminum) or metal alloy. Plastic polymer can also be used to manufacture the generally U-shaped member 280 and cartridge-pushing member 140 so long as the polymer is sufficiently resistant to deformation to allow repeated loading of cartridges C into the magazine clip of a weapon.

Still referring to FIGS. 1 and 2, a first tongue 360 and a second tongue 380 respectively extend in a generally downward direction from first and second opposite sides 325 and 330 at the rear end 400 of topside 320. The first and second tongues 360 and 380 respectively extend in a generally downward direction towards the rear end 420 of bottom side 340, and towards, but not touching, first and second bottom opposite sides 345 and 350, respectively. Alternatively, the first and second tongues 360 and 380 can touch or otherwise connect to opposite bottom sides 345 and 350, respectively.

Still referring to FIGS. 1 and 2, the thumb-protecting member 120 defines interior open cavity 200. More specifically, the front-end 300, topside 320, bottom side 340 and first and second tongues 340 and 360 collectively define an interior open cavity 200 of sufficient volume to accommodate the distal phalange DP of a person's thumb (see, e.g., FIG. 8).

Figure 9:
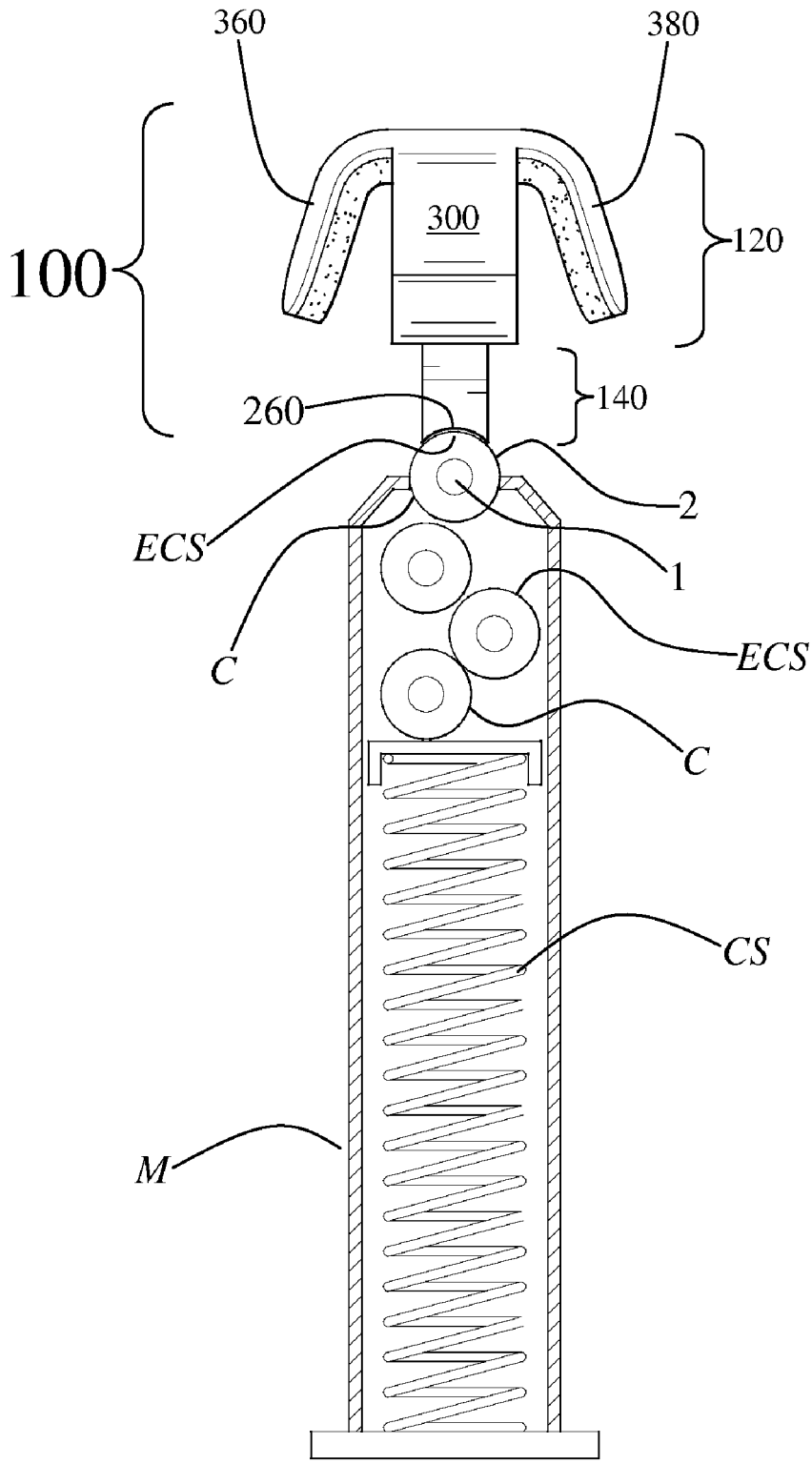
FIGS. 9 through 12 show further environmental views of the cartridge loader according to the present invention.
Figure 10:
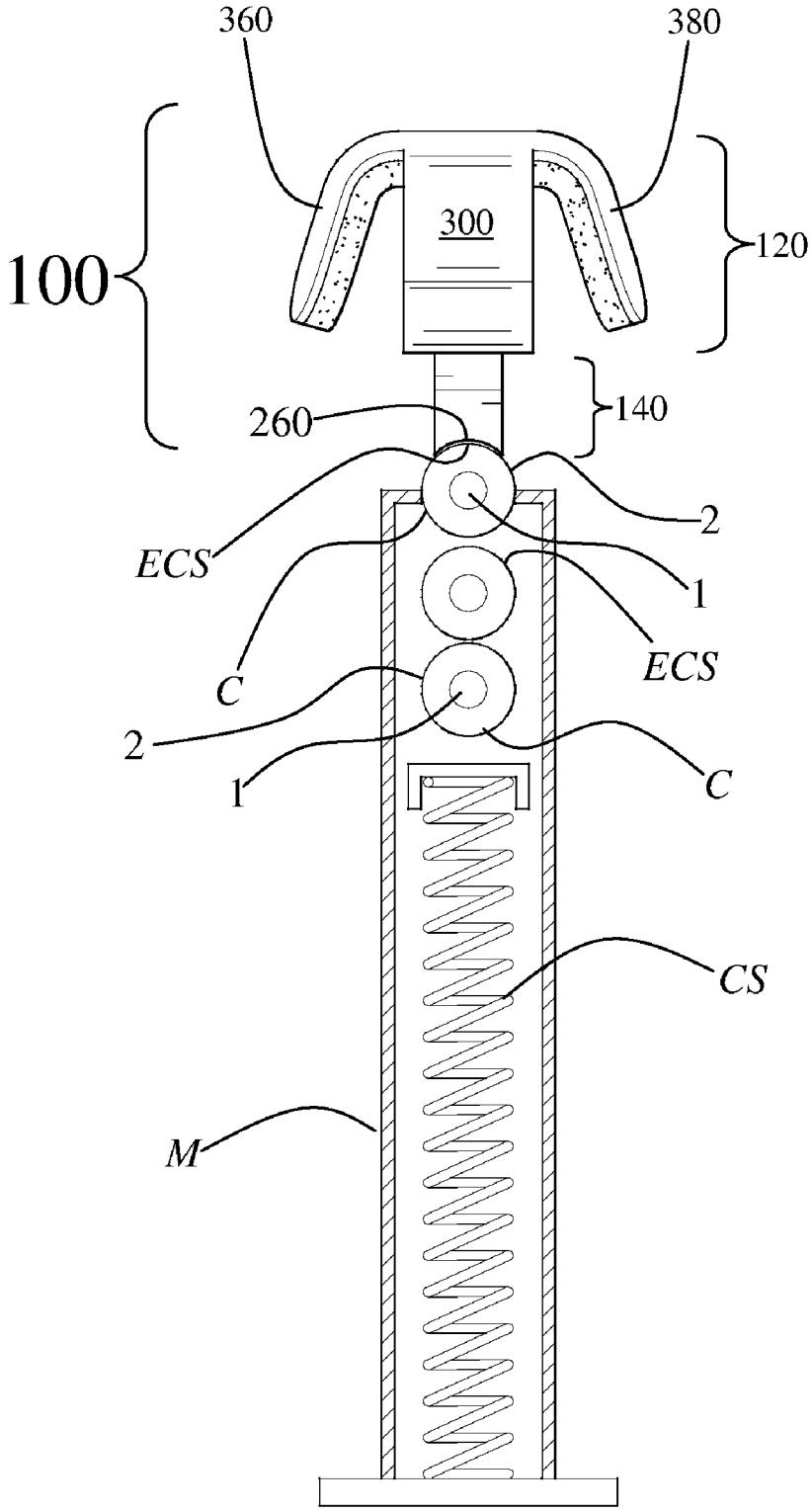
Figure 11:
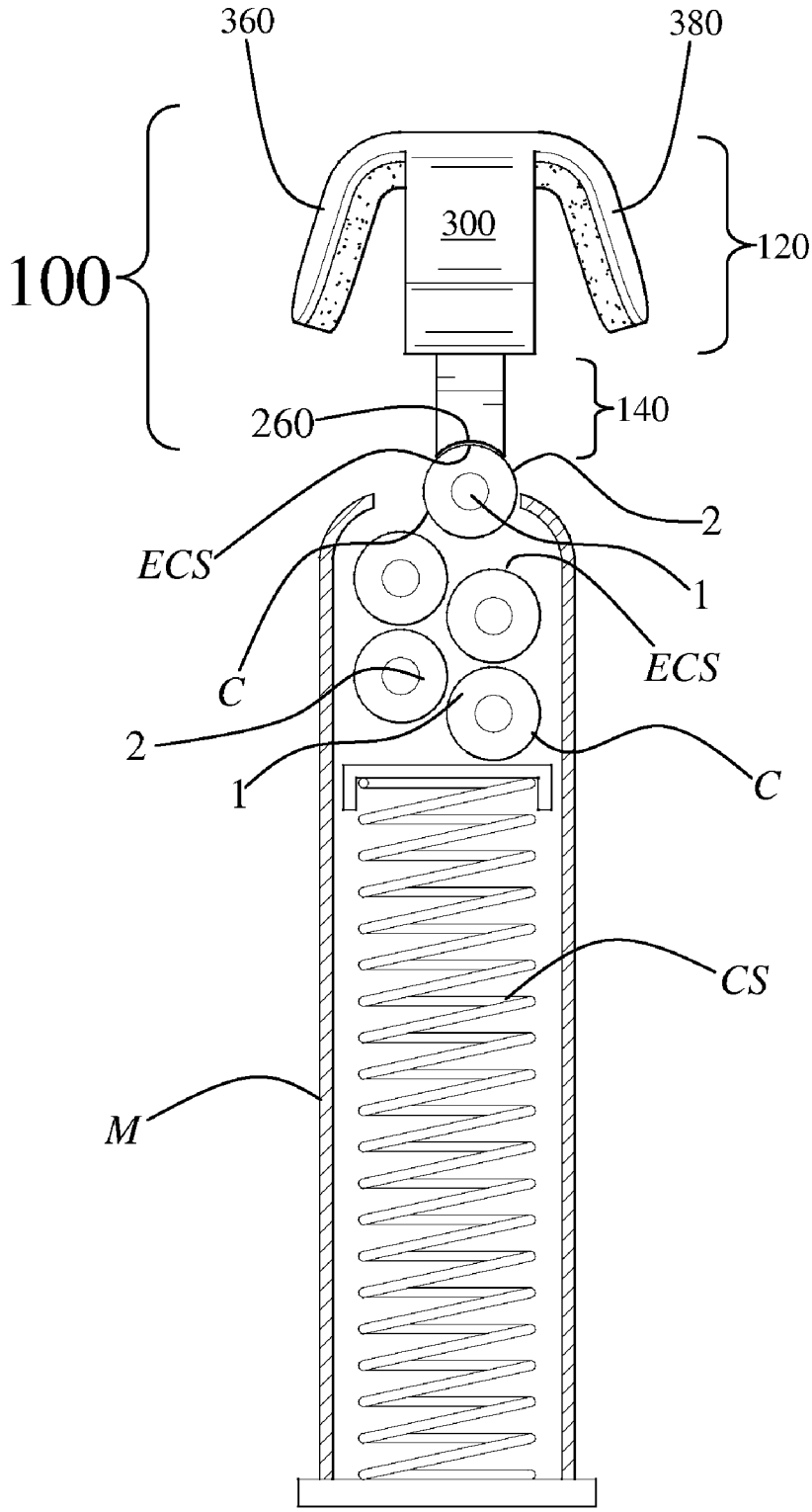
Figure 12:
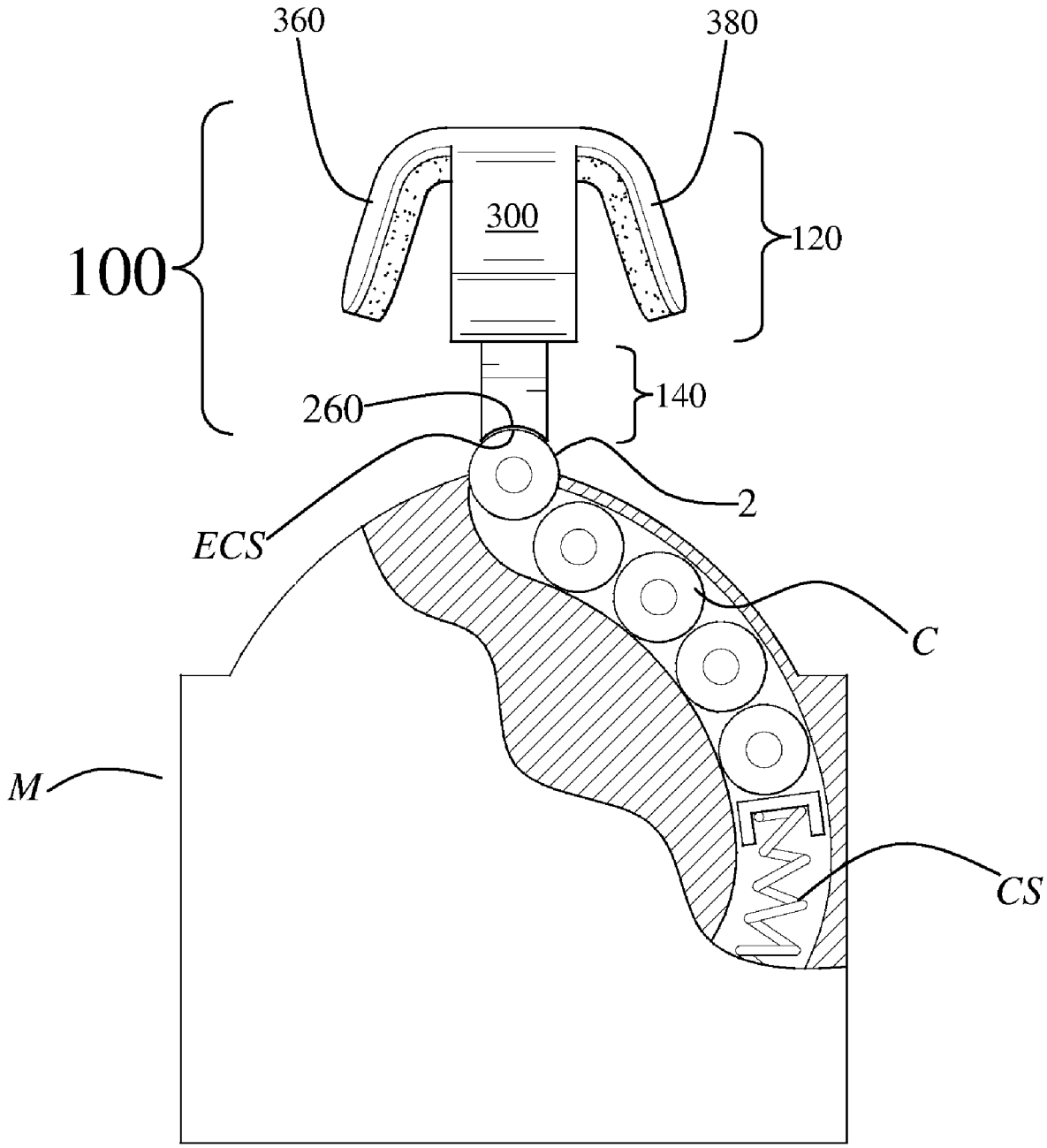

Still referring to FIGS. 1 and 2, the cartridge-pushing member 140 defines a length L and first and second opposite ends 220 and 240, respectively. The first end 220 is attached to the exterior surface 180 and more particularly to the exterior surface **180*b* of bottom side 340. The second end 240 of said cartridge-pushing member 140 defines, at least in part, a concave surface 260 adapted to suit the exterior shape ECS of a cartridge casing 2 (see, e.g., FIG. 9**).

Figure 3:
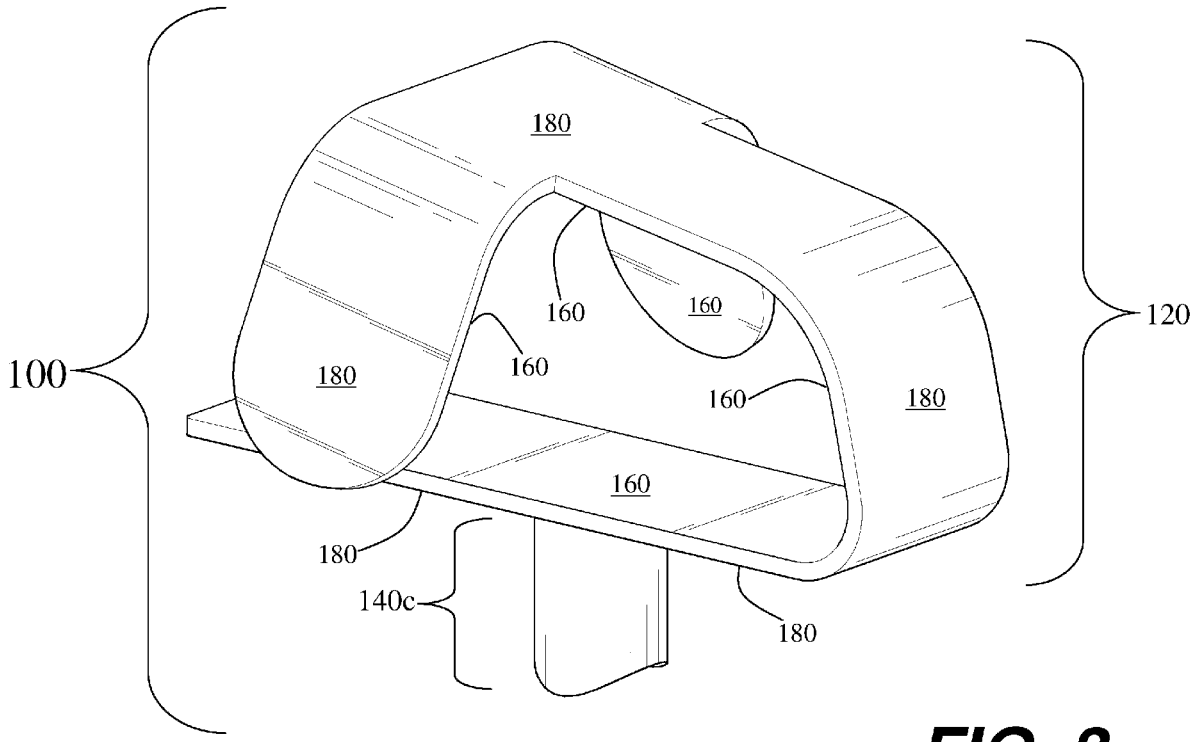
FIG. 3 shows a perspective view of a cartridge loader according to the present invention.

It should be understood that the elements that make up the cartridge loader 100 could vary without detracting from the scope of the invention. For example, the cross-section area (CSA) of the cartridge-pushing member 140 can be any suitable shape such as, but not limited to: square, rectangular, and circular. For example, the cartridge-pushing member 140 shown in FIGS. 1 and 2 has a square or rectangular cross-section. In contrast, the cartridge-pushing member 140 can have a circular cross-section area as shown in FIG. 3 where the cartridge-pushing member 140 is represented by the alphanumeric label "140*c*".

Figure 4:
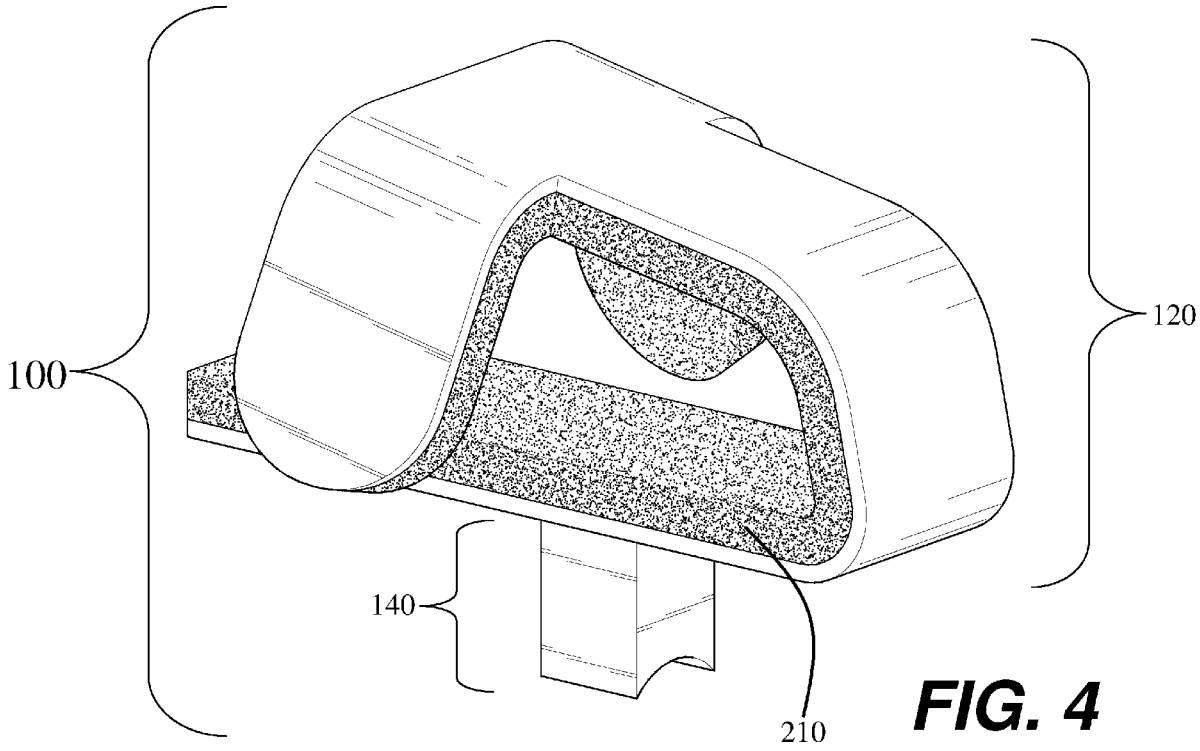
FIGS. 4 through 6 show the cartridge loader 100 of FIGS. 1 and 2, but fitted with optional lining 210.
Figure 5:
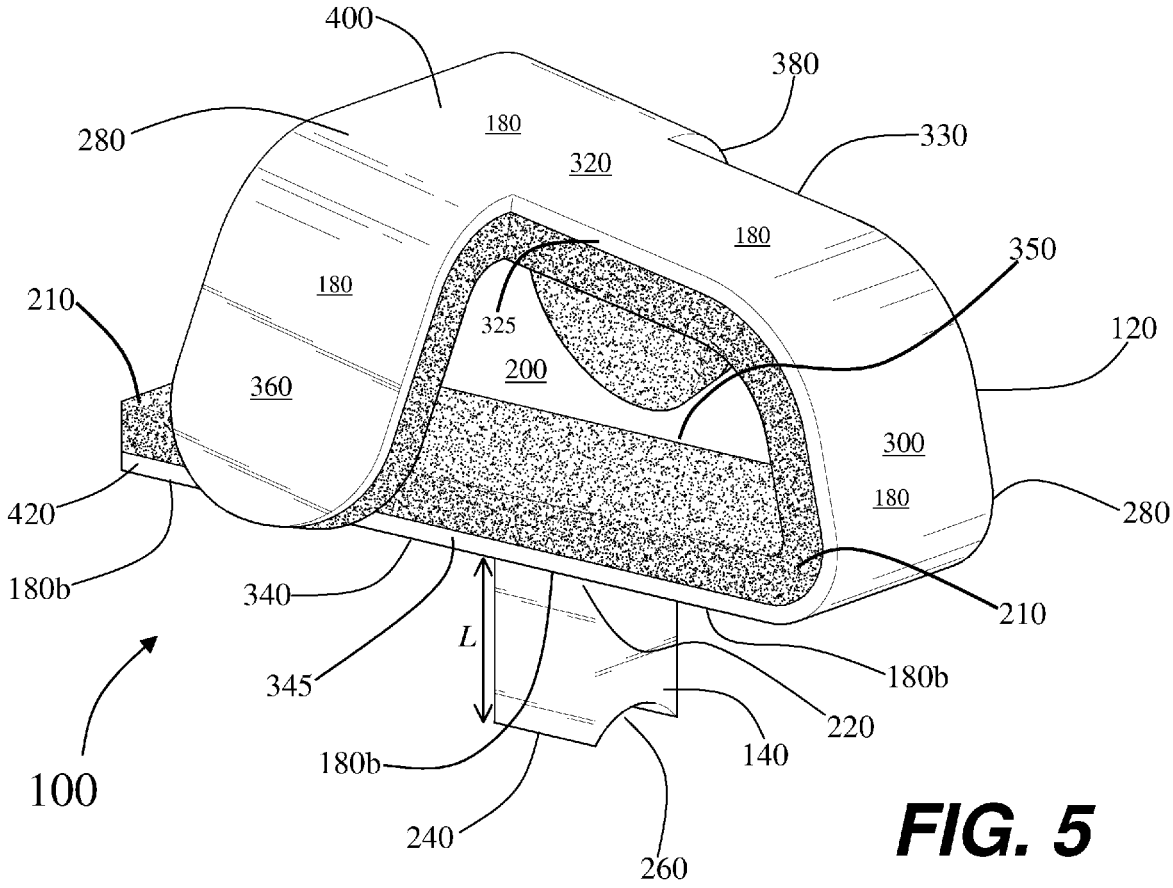
Figure 6:
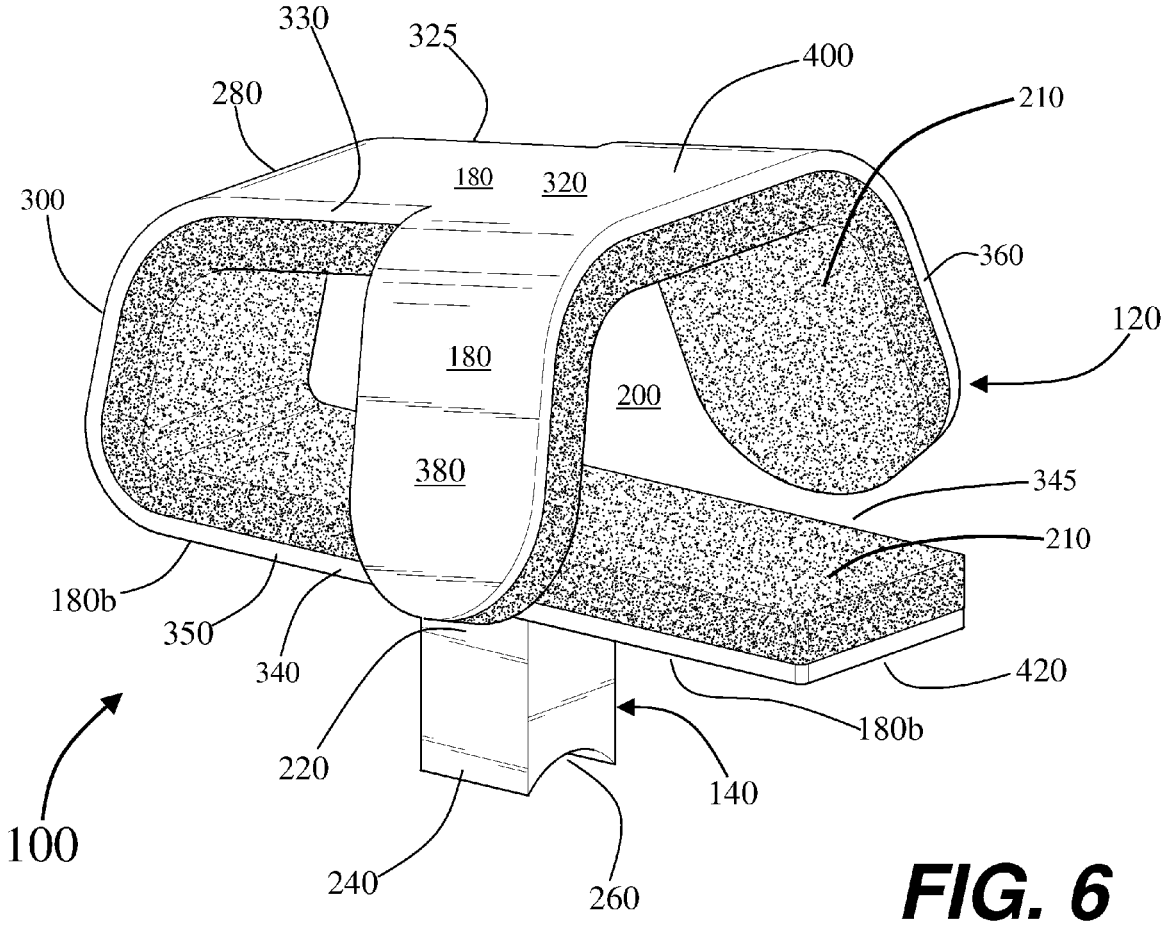

FIGS. 4-6 show the cartridge loader 100 of FIGS. 1 and 2, but fitted with optional lining 210. The optional lining 210 provides a snug fit for the distal phalange DP of a person's thumb thereby reducing the risk of the person's distal phalange DP slipping and thereby possibly interfering with or slowing down the loading of cartridges C into a magazine. The lining also prevents direct contact between the interior surface 160 and the distal phalange DP of a person's thumb thereby reducing the risk of the person developing light tissue damage such as, but not limited to, friction blisters.

Figure 7:
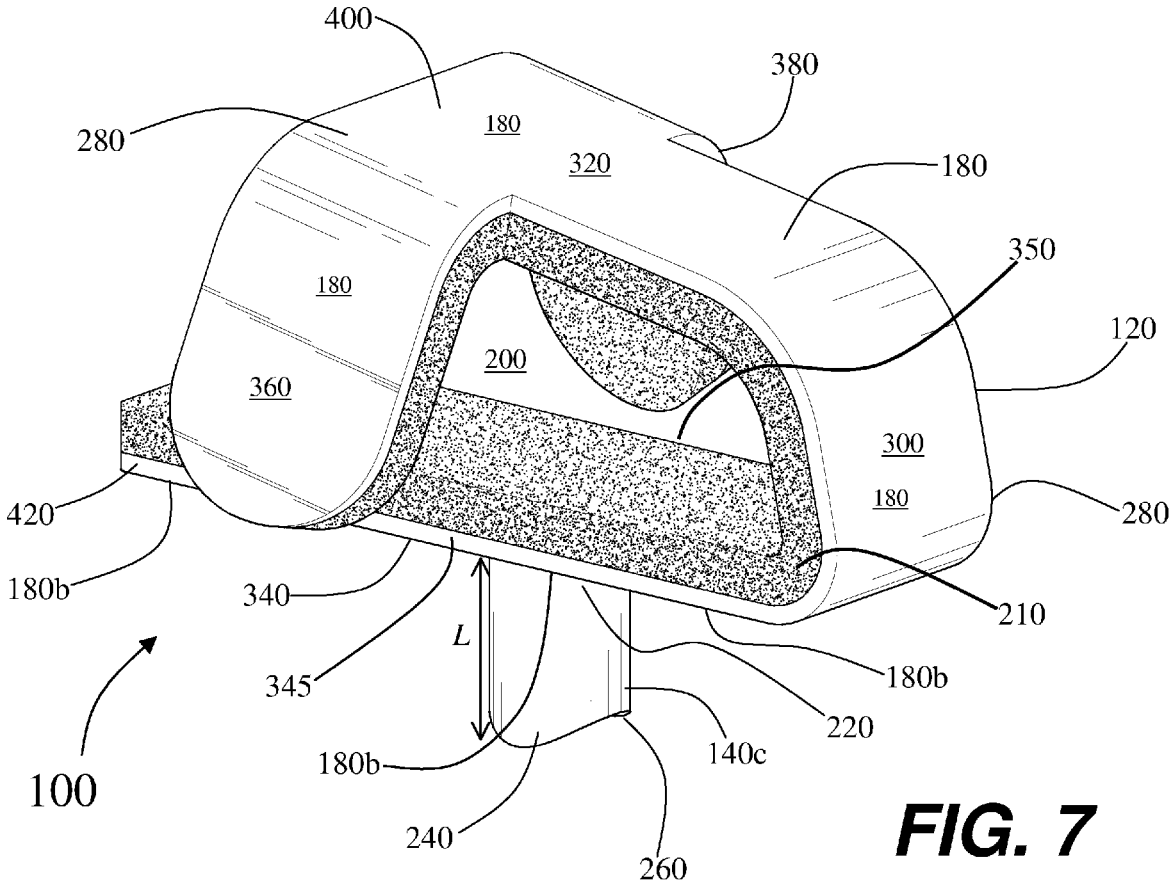
FIG. 7 show a perspective view of a cartridge loader according to the present invention.

FIG. 7 shows the cartridge loader 100 of FIGS. 4 and 5, but with a cartridge-pushing member 140*c* having a circular cross-section area.

Figure 8:
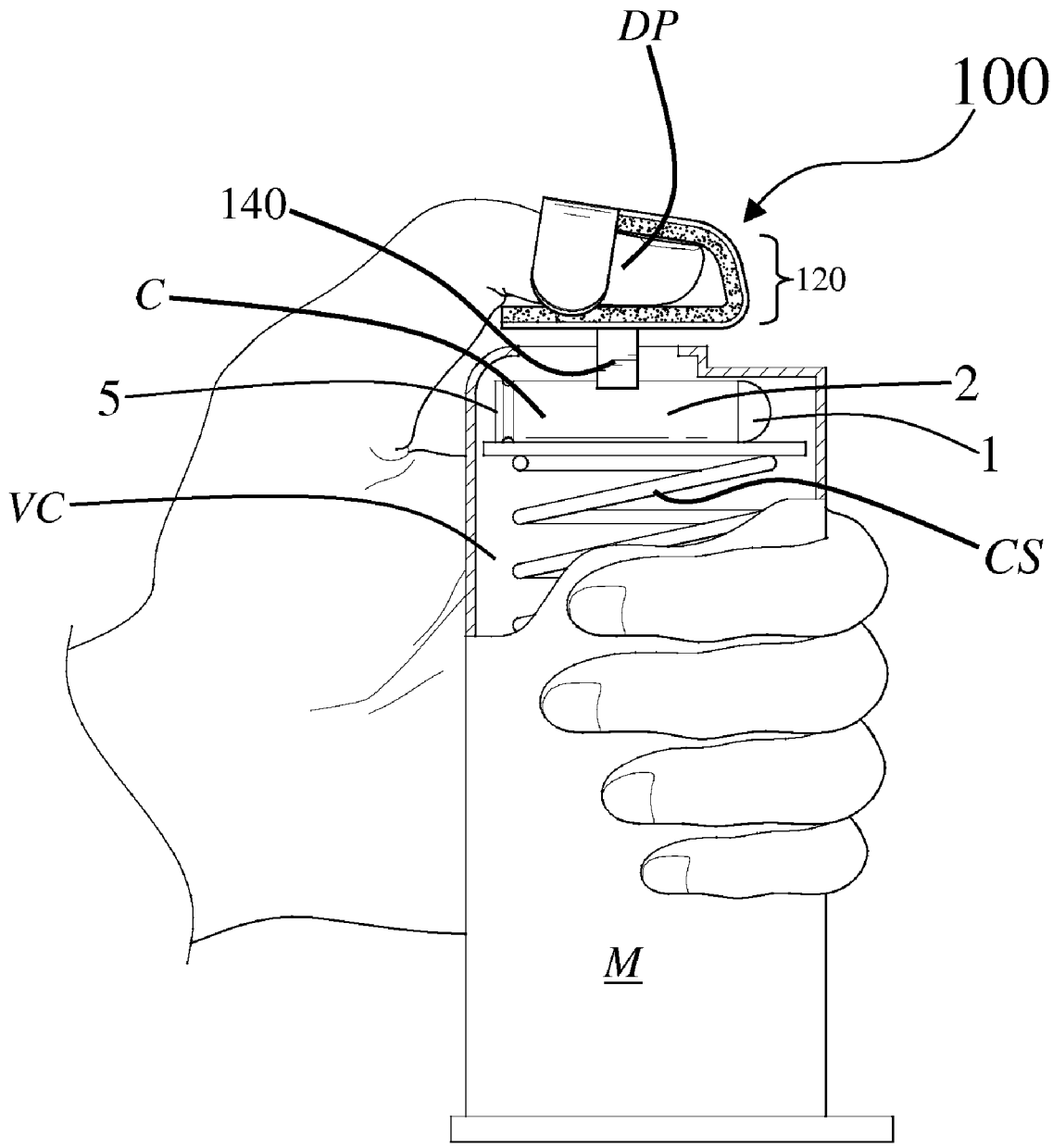
FIG. 8 shows an environmental view of the cartridge loader according to the present invention.

Referring to FIG. 8, which shows an environmental view of the cartridge loader 100, the cartridge loader 100 is shown fitted to a distal phalange DP of a person's thumb. More specifically, a distal phalange DP of a person's thumb is shown inserted into the thumb-protecting member 120 of cartridge loader 100. The cartridge loader 100 is being used to push a cartridge C down into a gun magazine M against the upward force exerted by a compression spring CS located inside the vertical chamber VC of magazine M. The opposite bullet 1 and primer 5 ends of the cartridges C is visible in the partial cutaway view of magazine M.

FIGS. 9 through 12 show further environmental views of the cartridge loader 100 in which the concave surface 260 of thumb-protecting member 120 fits snuggly against exterior cylindrical shape ECS of a cartridge casing 2.

Figure 13:
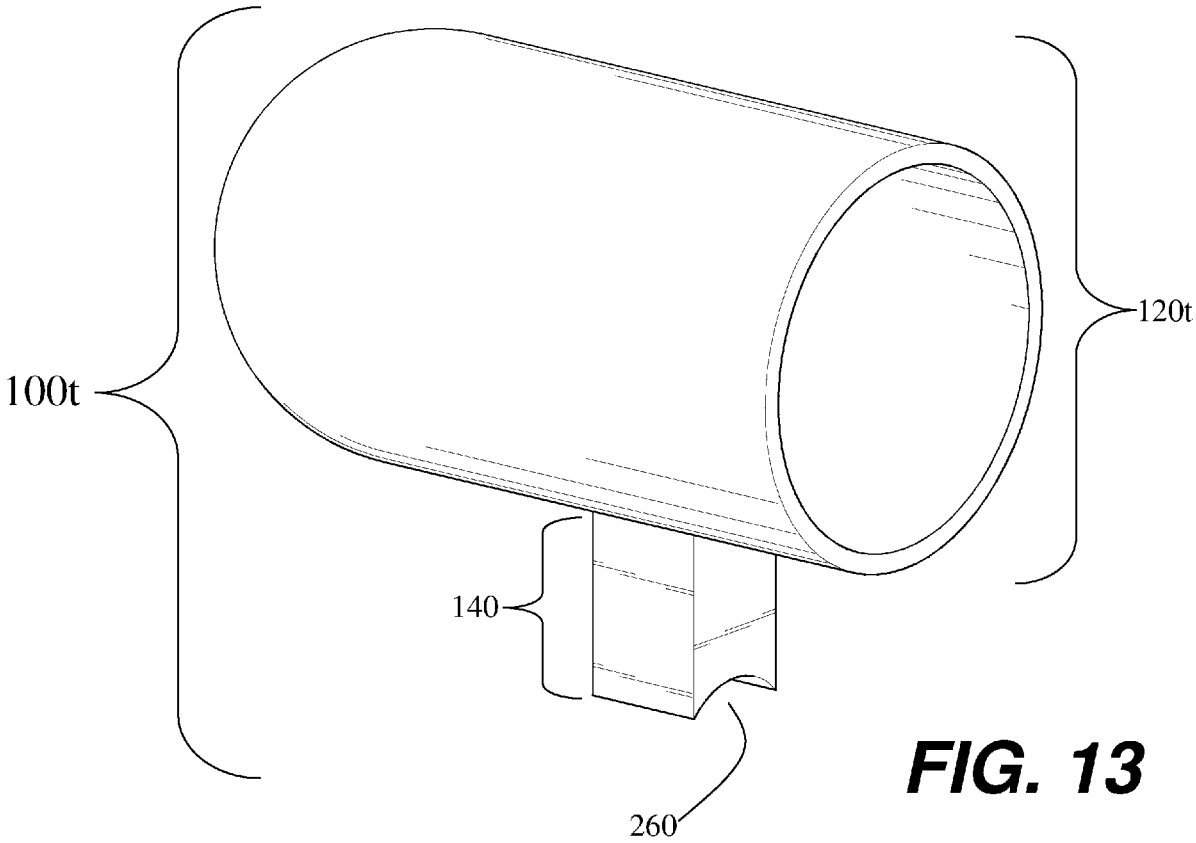
FIG. 13 shows a perspective view of a cartridge loader according to the present invention.

As noted above, it should be understood that the elements that make up the cartridge loader 100 could vary without detracting from the scope of the invention. For example, the cartridge loader (labeled "100*t*" in FIG. 13) has a thumb-protecting member 120 with a thimble shape "120*t*".

Figure 14:
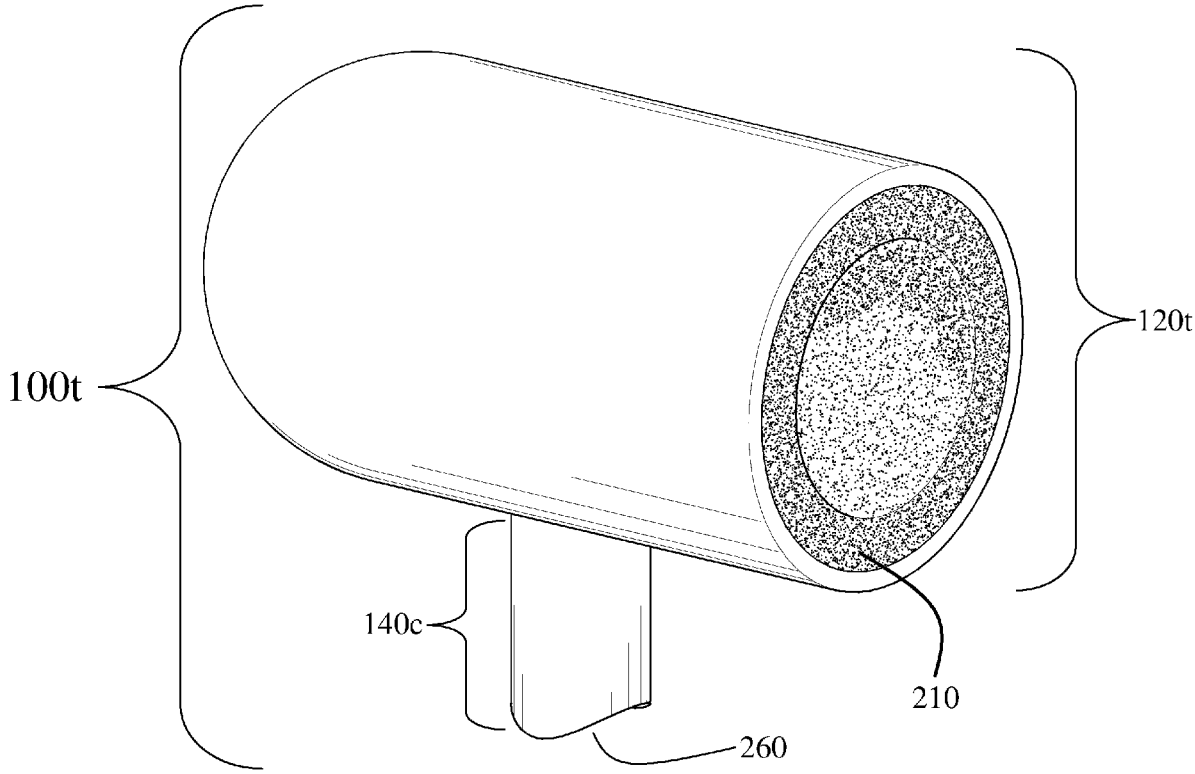
FIG. 14 shows a perspective view of a cartridge loader according to the present invention.
Figure 15:
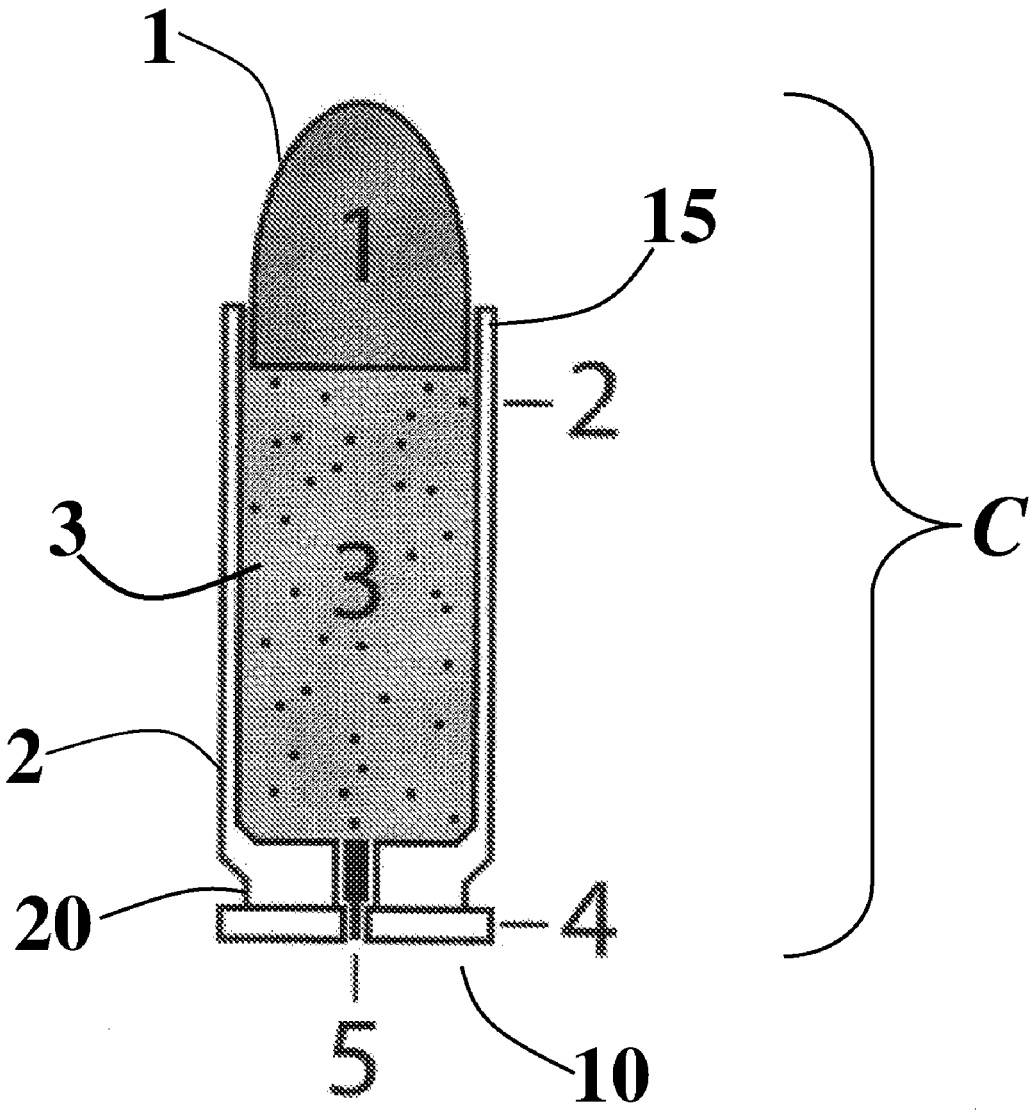
FIG. 15 shows a schematic view of a cartridge according to the prior art.

FIG. 14 shows a cartridge loader 100*t* fitted with the lining 210, and a cartridge-pushing member 140*c* with a circular cross-section shape. FIG. 15 shows a prior art cartridge as described in the background section above.

It is to be understood that the present invention is not limited to the embodiments described above, but encompasses any and all embodiments within the scope of the following claims.

I claim:

1. A cartridge loader (100) for inserting cartridges into a gun magazine, wherein said cartridge loader (100) fits onto a person's thumb and more particularly fits onto the distal phalange of a person's thumb, said cartridge loader (100) comprising:

a thumb-protecting member (120), said thumb-protecting member (120) defines interior (160) and exterior (180) surfaces, said thumb-protecting member (120) defines an interior open cavity (200) of sufficient volume to accommodate a distal phalange of a person's thumb, wherein said thumb-protecting member (120) is a U-shaped member (280) having a front-end (300), topside (320), bottom side (340), first tongue (360) and a second tongue (380), wherein said topside (320) defines first and second opposite sides (325) and (330) and rear end (400), said bottom side (340) defines a rear end (420), exterior surface (180*b*) and first (345) and second (350) opposite bottom sides, and wherein said first (360) and second (380) tongues respectively extend in a generally downward direction from said first side (325) and second side (330) at the rear end (400) of topside (320) towards said rear end (420) of bottom side (340); and a cartridge-pushing member (140), said cartridge-pushing member (140) having opposite first (220) and second (240) ends, said first end (220) of said cartridge-pushing member (140) is attached to the exterior surface (180*b*) of said bottom side (340) of said thumb-protecting member (140), and said second end (240) of said cartridge-pushing member (140) defines, at least in part, a concave surface (260) to suit the exterior shape of a cartridge casing.

2. The cartridge loader of claim 1, wherein said interior surface (160) is at least partly covered with a lining to provide a snug fit for the distal phalange DP of a person's thumb.

3. The cartridge loader of claim 1, wherein said cartridge-pushing member (140) has a square cross-section shape.

4. The cartridge loader of claim 1, wherein said cartridge-pushing member (140) has a rectangular cross-section shape.

5. The cartridge loader of claim 1, wherein said cartridge-pushing member (140) has a circular cross-section shape.

* * * * *